United States Patent [19]

Haehnel et al.

[11] 4,003,290

[45] Jan. 18, 1977

[54] STRAND CARRIER FOR A STRAND FABRICATING MACHINE

[75] Inventors: Rudolf Herbert Haehnel; Barry Lee Graeff, both of Reading, Pa.

[73] Assignee: Rockwell International Corporation, Pittsburgh, Pa.

[22] Filed: Apr. 23, 1976

[21] Appl. No.: 679,763

[52] U.S. Cl. ..... 87/57; 87/21; 192/81 C; 242/129.8

[51] Int. Cl.[2] ..... D04C 3/14; F16D 11/06

[58] Field of Search ..... 87/21, 22, 56, 57; 242/45, 129.8, 147 R; 192/12 R, 12 BA, 41 S, 81 R, 81 C

[56] References Cited

UNITED STATES PATENTS

| | | | |
|---|---|---|---|
| 3,408,893 | 11/1968 | Singh | 87/57 X |
| 3,817,147 | 6/1974 | Richardson | 87/57 |
| 3,839,939 | 10/1974 | Wily | 87/57 |
| 3,882,757 | 5/1975 | Weatherby | 87/57 |

*Primary Examiner*—John Petrakes

[57] ABSTRACT

A strand carrier for a strand fabricating machine includes a support structure and a shaft mounted thereon. A hub is mounted for rotation around the shaft for receipt of a bobbin of strand thereon for common rotation about the shaft. A helical clutch spring includes a first end secured to the support structure so that it closely encircles an outer cylindrical surface of the hub to restrict rotation thereof. A clutch release sleeve is rotatably mounted on the support structure around the clutch spring and receives the other end of the spring in an opening therein so that rotation of the clutch release sleeve in a first direction will tend to unwind the clutch spring to reduce friction on the hub. A control lever pivotally mounted on the support structure has a first section which includes a strand guide thereon and is connected to the sleeve. The lever is biased in a direction tending to rotate the sleeve in an opposite direction from the first direction. A plurality of additional strand guides are mounted on the support structure to direct the strand being unwound from the bobbin to and around the strand guide of the first section to apply a resulting force on the strand guide during unwinding in a direction in opposition to the biasing of the lever.

7 Claims, 3 Drawing Figures

STRAND CARRIER FOR A STRAND FABRICATING MACHINE

BACKGROUND OF THE INVENTION

1. Field of the Invention

This invention relates to a strand carrier for a strand fabricating machine, such as in a winding or braiding machine and more specifically, to such a carrier which controls the rotation of the bobbin to ensure controlled unwinding of the strand therefrom.

2. Description of the Prior Art

There have heretofore been used a number of braiding machines in the strand fabricating art such as those disclosed in U.S. Pat. Nos. 1,059,523, 1,491,839 and 1,888,477 and, more recently, in U.S. Pat. No. 3,756,117. Throughout the use of such machines there has been a continuing concern for controlled unwinding of the strand from the various bobbins used thereon. It is important to maintain the strands in a taunt condition throughout braiding to prevent ballooning as the strands are rapidly and repeatedly directed inwardly and outwardly of each other. As braiding machine speeds increase, control of the strands becomes even more critical.

Accordingly, there have existed a number of strand carrier devices in the past designed for controlled unwinding of strands from the bobbins. One type has been particularly popular includes a ratchet feature which controllably restricts and releases the bobbin for rotation to supply the strand according to the demand thereon. This type of carrier is generally disclosed in U.S. Pat. Nos. 3,004,463, 3,045,526, 3,038,367, 3,324,757, 3,362,282 and 3,425,315. There also exists a number of strand carriers which employ a variable braking approach by the application of frictional force through a disc or shoe type device to restrict rotation of a bobbin according to the demand for strand therefrom. Various strand carriers utilizing this type of configuration are demonstrated in U.S. Pat. Nos. 2,024,104, 2,988,300, 3,756,533 and 3,002,643.

However, in both general types of control utilized in the embodiment described hereinabove, there have existed problems which have affected their attractiveness for use in braiding machines. The first type is quite noisy and the repeated stopping and starting of the bobbin has not always provided the desired smooth operation which rapid braiding machines require. The second type, although operating much quieter and smoother, employed braking systems which were difficult to control and adjust.

Consequently, it is not surprising that a new method of controlling the rotation of a bobbin has been employed which eliminates the disadvantages of the devices described hereinabove. This new method employs a helical clutch spring which closely encircles a hub portion of the bobbin carrier for controlled application of friction thereto. Configurations which generally employ a clutch spring can be seen in U.S. Pat. Nos. 3,727,732, 3,817,147, 3,839,939 and 3,882,757. However, even strand carriers which have heretofore utilized this method have been found to be extremely complicated or to lack simple but adequate means for proper adjustment when used on winding or braiding machines.

SUMMARY OF THE INVENTION

It is, therefore, an object of the invention to provide a strand carrier for a strand fabricating machine which includes a helical clutch spring which is automatically controlled to vary the friction for properly supplying strand from a bobbin.

It is another object to provide a strand carrier of the type described which includes convenient and simple means for adjusting the same.

It is still another object to provide a strand carrier of the type described which is inexpensive to provide and uncomplicated to maintain.

These and other objects of the invention are provided in a preferred embodiment thereof which includes a strand carrier for a strand fabricating machine having a support structure mounted on the machine and a shaft mounted on the support structure. A hub is mounted on the support structure for rotation around the shaft and includes means thereon for receiving a bobbin of strand on the shaft in a fixed relationship with the hub for common rotation about the shaft. A helical clutch spring has a first end fixedly secured at the support structure, an intermediate portion which is biased to closely encircle an outer cylindrical surface of the hub to restrict rotation of the hub by generation of friction therebetween and a second end which is disposed outwardly of the hub. A clutch release sleeve is rotatably mounted on the support structure around the clutch spring and is capable of rotation in a first direction to cause a surface portion thereof adjacent said clutch spring to contact and angularly displace said second end of said clutch spring which displacement tends to unwind the clutch spring to reduce the friction on the hub. A control lever is pivotally mounted on the support structure and has a first section and a second section thereon remote from an axis of rotation of the lever. The first section is adjacent the sleeve and has a strand guide mounted thereon. The carrier includes means for connecting the first section of the lever to the sleeve and means for biasing the second section of the lever in a direction to cause the first section to rotate the sleeve in an opposite direction from the first direction. There is included means for guiding the strand from the bobbin, to and around the strand guide of the first section and to a work area of the machine. The means for guiding the strand is located with respect to the strand guide to cause the strand to apply a resulting force thereon in opposition to the means for biasing the second section of the lever.

DESCRIPTION OF THE PREFERRED EMBODIMENT

Figure 1:
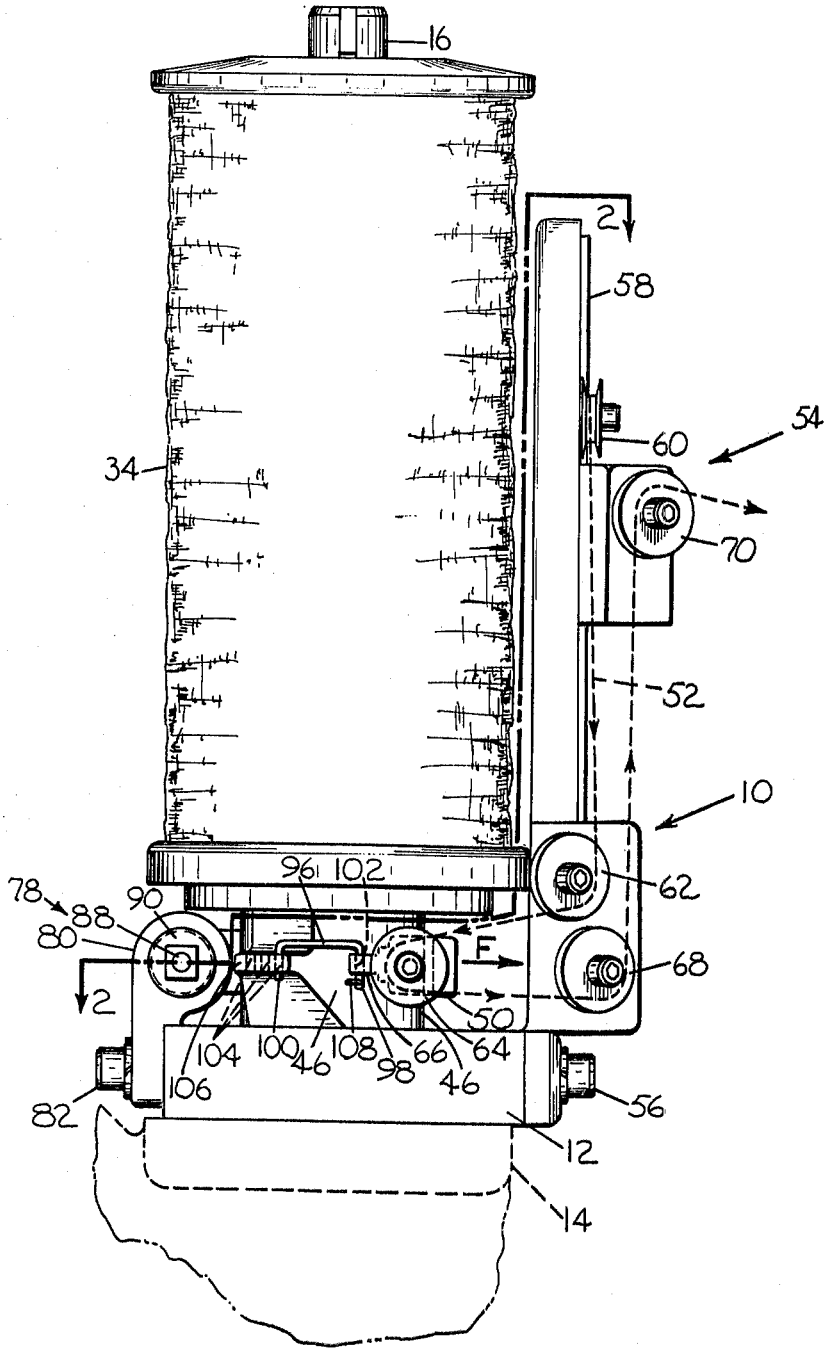
FIG. 1 is a side elevational view of the preferred strand carrier including various features of the invention.
Figure 3:
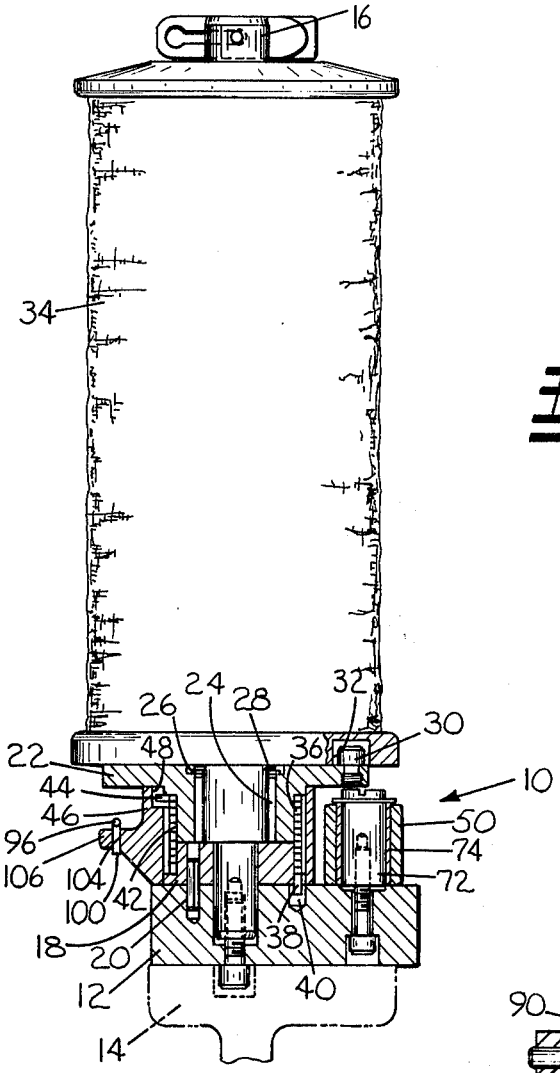
FIG. 3 is a view of the preferred strand carrier as generally seen along the line 3—3 of FIG. 2.
Figure 2:
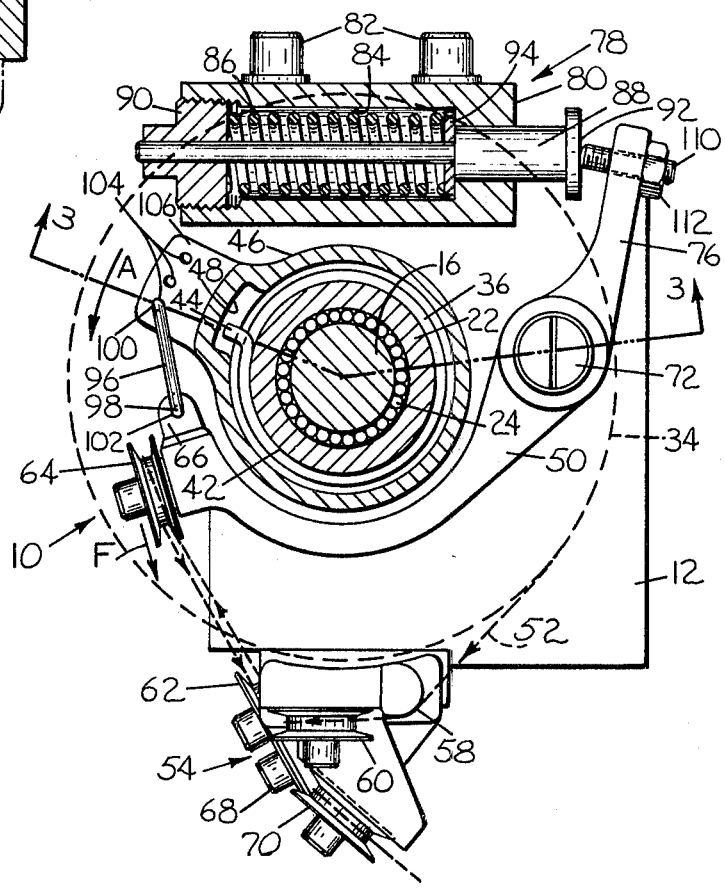
FIG. 2 is a view of the preferred strand carrier as seen along line 2—2 of FIG. 1.

As seen in FIGS. 1, 2 and 3, a preferred strand carrier 10 includes a support structure 12 which is securely mounted to a portion 14 of a strand fabricating machine (not shown). The support structure 12 includes a stationary hub 18 and, as best seen in FIG. 3, a shaft 16 extends through the stationary hub 18 to be rigidly mounted on the support structure 12. The stationary hub 18 is prevented from rotating about the shaft 16 by a roll pin 20 which is inserted in aligned holes respectively in the stationary hub 18 and the remaining portion of the support structure 12.

A rotating hub 22 is rotatably mounted about the shaft 16 and includes a bearing 24, washer 26 and retaining ring 28 to ensure its retention thereon. The hub 22 includes at least one upwardly extending drive pin 30 aligned for receipt within a hole 32 of a bobbin 34 which is installed on the shaft 16. Accordingly, in the general configuration described hereinabove, the hub 22 and bobbin 34 are mounted for common rotation around the shaft 16.

To generally restrict rotation of the hub 22 and the bobbin 34, the carrier 10 includes a helical clutch spring 36. The clutch spring 36 generally encircles the stationary hub 18 and the rotatable hub 22 and includes a first end 38 which is received within a hole 40 of the support structure 12 to prevent its rotation. Natural biasing of the clutch spring 36 is such that the clutch spring 36 tightly grips the outer cylindrical surface 42 of the hub 22 and thereby tends to restrict its rotation by the frictional contact therebetween. However, a second end 44 of the clutch spring 36 extends outwardly of the surface 42 and can be angularly positioned to alter the frictional force applied to the hub 22 as will be explained hereinbelow.

As seen in FIG. 2, the carrier 10 includes a clutch release sleeve 46 which is mounted around the stationary hub 18, the rotating hub 22 and the clutch spring 36. The clutch release sleeve 46 includes an opening 48 in its interior surface which is generally aligned with the clutch spring 36 to receive the second end 44 therein. Rotation of the clutch release sleeve 46 in a direction as indicated by the arrow A will, therefore, cause the interior wall of the opening 48 to angularly displace the end 44 to thereby unwind the clutch spring 36 against its natural biasing to reduce the frictional forces tending to restrict rotation of the hub 22. To control the position of the clutch release sleeve 46 during operation of the carrier 10, a control lever 50 is provided to ensure the carrier 10 will respond to the demand of the strand fabricating machine for the strand being supplied by the bobbin 34.

As also seen in FIG. 1, the strand 52 (shown as a dotted line with arrows included therein to indicate the direction of travel) leaves the bobbin 34 to pass through a strand guiding device 54 before being directed to a work area (not shown) of the strand fabricating machine. The strand guiding device 54 is rigidly secured to the support structure 12 by bolts 56 and includes a vertically extending bailer bar 58 for proper alignment of the strand 52 independent of its axial position on the bobbin 34. The strand 52 is first caused to pass about a first roller 60 adjacent the bailer bar 58 and then downwardly therefrom around a second roller 62. From the roller 62 the strand 52 passes around a strand guide roller 64 which is mounted on a first section 66 of the lever 50. From the strand guide roller 64, the strand 52 goes around a third roller 68 and a fourth roller 70 of the strand guiding device 54 prior to its being directed to the work area of the machine. As will be apparent to those skilled in the art, any number of strand guiding devices might be employed to remove the strand from the bobbin and to eventually direct it to the work area. However, as will be understood from the description provided hereinbelow, it is of significance that the location of the preferred strand guiding device 54 is such that the strand 52 tends to produce a resulting force on the strand guide roller 64 in a direction as indicated by the arrow F as it is pulled toward the work area.

Returning to FIGS. 2 and 3, it can be seen that the lever 50 is mounted for rotation about a pivot pin 72 which is secured to the support structure 12. A bushing 74 around the pin 72 ensures a minimum of resistance to rotate. A second section 76 of the lever 50 generally extends in an opposite direction from the first section 66 mentioned hereinabove. As will be understood from the description provided hereinbelow, it is desirable to provide a means for biasing the lever 50 in opposition to the force F which is applied thereto by the strand 52. In the preferred strand carrier 10 this biasing force is applied to the second section 76 by a strand tensioning device 78. The strand tensioning device 78 includes a housing 80 which is rigidly mounted to the support structure 12 by bolts 82. The housing 80 includes a cavity 84 therein for retention of a spring 86 and plunger 88. The spring 86 and plunger 88 are retained within the cavity 84 by an adjustable retainer 90 which is threadably received within the cavity 84. The plunger 88 includes a first end 92 aligned to make contact with the second section 76 of the lever 50. A washer 94 intermediately disposed on the plunger 88 makes abutting contact with one end of the spring 86 as the other end of the spring 86 rests against the adjustable retainer 90. Accordingly, as seen in FIG. 2, movement of the second section 76 of the lever 50 to the left, as may occur when the force F is applied to lever 50, will be opposed by the biasing force of the spring 86.

With the control lever 50 so arranged, it is essential for it to control the position of the clutch release sleeve and that there be some connection therebetween. A rigid connecting link 96 is provided for this purpose in the preferred strand carrier 10. The connecting link 96 includes a first leg 98 and a second leg 100 with an extension therebetween to extend from the clutch release sleeve 46 to the adjacent first section 66 of the lever 50. With the first leg 98 installed in a hole 102 through the first section 66 and the second leg 100 installed in one of the plurality of holes 104 in an extended portion 106 of the clutch release sleeve 46, movement of the first section 66 will produce a generally corresponding movement of the clutch release sleeve 46.

As thus described, the preferred strand carrier 10 includes the necessary elements for proper control of the bobbin 34 to ensure some tension will be maintained on the strand 52 as it is being supplied to the work area of the strand fabricating machine. As seen in FIG. 2, the clutch spring 36 will through its natural biasing prevent rotation of the bobbin 34. As strand 52 is demanded by the machine, a pulling force toward the work area will be transmitted to the strand guide roller 64 in a direction as indicated by force F. Force F will increase until it is of sufficient magnitude to overcome the biasing force created by spring 86 to cause the lever 50 to pivot in a counter-clockwise direction. Movement of the first section 66 of the lever 50 will produce corresponding rotation of the clutch release sleeve 46 because of their being joined by the connecting link 96. Counter-clockwise rotation of the clutch release sleeve 46 will continue until the walls of the opening 48 make contact with the second end 44 of the clutch spring 36 to angularly displace it against its natural biasing to thereby reduce the frictional force on the cylindrical surface 42 of the rotatable hub 22. As the hub 22 and the bobbin 34 are allowed to rotate, the resisting force on the strand 52 is decreased thereby decreasing the force F. When the force F has sufficiently decreased to allow the spring 86 to reposition the lever 50 by a clockwise movement thereof, the clutch release sleeve will also be moved in a clockwise direction. With the second end 44 of the clutch spring 36 unrestricted by the opening 48, the hub 22 and bobbin 34 will again be restricted from rotation by the clutch spring 36.

Although some cycling of the system as described hereinabove is likely to occur during braiding, it is desirable to provide a sufficient means for simple, convenient adjustment of the strand carrier 10 to provide as smooth an operation as is possible. Therefore, to initially establish a desired angular position of the clutch release sleeve 46 with respect to the second end 44 of the clutch spring 36, a plurality of holes 104 are provided through the extended portion 106. The angular position is determined by preselecting which of the holes 104 is to receive the second leg 100 of the connecting link 96. A hitch pin clip 108 can be removed from a hole in the lower end of the first leg 98 of the connecting link 96 to allow repositioning of the connecting link 96 and then reinstalled to prevent accidental dislocation of the connecting link 96 during operation of the strand carrier 10.

The plurality of holes 104 provide for step adjustment but additional finer adjustment is also provided by the inclusion of a threaded contact pin 110 through the second section 76 of the lever 50. By adjusting the axial position of the contact pin 110 with respect to the second section 76 and by securing it in that position by tightening of the nut 112 mounted thereon, the initial angular position of the lever 50 can be altered with respect to the plunger 88 as the contact pin 110 is located against the end 92. This angular position accurately locates an initial position of the first section 66 which, in turn, through connecting line 96, determines the angular position of the clutch release sleeve 46 relative to the second end 44 of the clutch spring 36.

Finally, to regulate the magnitude of force F, and thus the operating tension on the strand 52, the biasing force of the strand tensioning device 78 can be adjusted by selectively positioning the adjustable retainer 90 within the housing 80. The adjustable retainer 90 can, therefore, increase or decrease the compression of the spring 86 to alter the biasing force on the lever 50. When biasing is decreased, less force will be required by the strand 52 to relocate the clutch release sleeve 46 and thereby allow rotation of the bobbin 34 before a greater tension on the strand 52 can be produced.

Although it will be obvious to those skilled in the art that a number of alterations could be made to the preferred embodiment described hereinabove without departing from the invention as claimed, the configuration of the embodiment described hereinabove does allow a number of simple, convenient adjustments for proper carrier operation during braiding. It should be obvious, however, that, for example, the plurality of holes through the clutch release sleeve could be alternatively provided through the first section of the lever. Additionally, the fine adjustment to the initial angular position of the lever might also be accomplished by adjusting the axial position of the plunger rather than a contact pin. It would also be obvious to apply a biasing force to the lever at a second section thereof which has a predetermined, fixed angular relationship with respect to the first section which is significantly different from that described hereinabove.

We claim:

1. A strand carrier for a strand fabricating machine comprising:

a support structure mounted on said machine;

a shaft mounted on said support structure;

a hub mounted on said support structure for rotation around said shaft and including means thereon for receiving a bobbin of strand on said shaft in a fixed relationship with said hub for common rotation about said shaft;

a helical clutch spring having a first end fixedly secured at said support structure, an intermediate portion which is biased to closely encircle an outer cylindrical surface of said hub to restrict rotation of said hub by generation of friction therebetween and a second end which is disposed outwardly of said hub;

a clutch release sleeve rotatably mounted on said support structure around said clutch spring and said hub, said sleeve being capable of rotation in a first direction to cause a surface portion thereof adjacent said clutch spring to contact and angularly displace said second end of said clutch spring which displacement tends to unwind said clutch spring to reduce said friction on said hub;

a control lever pivotally mounted on said support structure and having a first section and a second section thereon remote from an axis of rotation of said lever, said first section being adjacent said sleeve and having a strand guide thereon;

means for connecting said first section of said lever to said sleeve;

means for biasing said second section of said lever in a direction to cause said first section to rotate said sleeve in an opposite direction from said first direction; and means for guiding said strand from said bobbin, to and around said strand guide of said first section, and to work area of said machine, said means for guiding being located with respect to said strand guide to cause said strand to apply a resulting force on said control lever in opposition to said means for biasing.

2. The strand carrier as set forth in claim 1, wherein said means for connecting is selectively adjustable to vary the distance between said first section of said lever and said sleeve.

3. The strand carrier as set forth in claim 2, wherein said means for connecting includes a rigid connecting link having a first leg received within a first hole in one of said first section and said sleeve and a second leg selectively received within one of a plurality of second holes in the other of said first section and said sleeve.

4. The strand carrier as set forth in claim 1, wherein said means for biasing includes means for adjusting said biasing to generate a predetermined force on said second section of said lever.

5. The strand carrier as set forth in claim 4, wherein said means for biasing includes a plunger aligned to make contact with a portion of said second section and a compressed spring acting on said plunger.

6. The strand carrier as set forth in claim 5, wherein said means for adjusting said biasing includes a housing for said compressed spring and said plunger and a retaining element threadably received within said housing to selectively vary the amount of compression of said compressed spring.

7. The strand carrier as set forth in claim 5, wherein at least one of said plunger and said portion of said second section of said lever includes an adjustable contact device to preselect the initial angular position of said lever with respect to said support structure when there is contact between said portion and said plunger.

* * * * *